US005156099A

United States Patent [19]

Ohshita et al.

[11] Patent Number: 5,156,099

[45] Date of Patent: Oct. 20, 1992

[54] COMPOSITE RECYCLING TYPE FLUIDIZED BED BOILER

[75] Inventors: Takahiro Ohshita; Shuichi Nagato; Norihisa Miyoshi, all of Kanagawa, Japan

[73] Assignee: Ebara Corporation, Tokyo, Japan

[21] Appl. No.: 445,679

[22] PCT Filed: Aug. 30, 1989

[86] PCT No.: PCT/JP89/00883

§ 371 Date: Nov. 29, 1989

§ 102(e) Date: Nov. 29, 1989

[87] PCT Pub. No.: WO90/02293

PCT Pub. Date: Aug. 3, 1990

[30] Foreign Application Priority Data

Aug. 31, 1988 [JP] Japan ..... 63-125135

[51] Int. Cl.[5] ..... F23G 7/00

[52] U.S. Cl. ..... 110/245; 122/4 D

[58] Field of Search ..... 110/245; 122/4 D

[56] References Cited

U.S. PATENT DOCUMENTS

| | | | |
|---|---|---|---|
| 4,414,905 | 11/1983 | Beranek et al. | 110/245 |
| 4,419,330 | 12/1983 | Ishihara et al. . | |
| 4,434,726 | 3/1984 | Jones | 110/245 |
| 4,449,482 | 5/1984 | Leon et al. . | |
| 4,452,155 | 6/1984 | Ishihara et al. . | |
| 4,556,017 | 12/1985 | Couch et al. . | |
| 4,823,740 | 4/1989 | Ohshita et al. . | |
| 4,867,079 | 9/1989 | Shang et al. | 110/245 |
| 4,879,958 | 11/1989 | Allen et al. | 122/4 D |
| 4,940,007 | 7/1990 | Hiltuner et al. | 110/245 |
| 4,962,711 | 10/1990 | Yamanchi et al. | 122/4 D |

FOREIGN PATENT DOCUMENTS

| | | |
|---|---|---|
| 0124636 | 11/1984 | European Pat. Off. . |
| 0230309 | 7/1987 | European Pat. Off. . |
| 2449798 | 4/1976 | Fed. Rep. of Germany . |
| 63-73091 | 4/1963 | Japan . |
| 63-143409 | 6/1963 | Japan . |
| 55-135195 | 10/1980 | Japan . |
| 57-139205 | 8/1982 | Japan . |
| 62-141408 | 6/1987 | Japan . |
| 63-131916 | 6/1988 | Japan . |
| 1081739 | 8/1967 | United Kingdom . |
| 2046886 | 11/1980 | United Kingdom . |
| 2151503 | 1/1985 | United Kingdom . |

OTHER PUBLICATIONS

"Evaluation of the Fluidized-Bed Combustion Process", vol. 1, by D. L. Keairns et al., Dec. 1973, Environmental Protection Agency, Washington, D.C.

*Primary Examiner*—Henry C. Yuen

*Attorney, Agent, or Firm*—Wenderoth, Lind & Ponack

[57] ABSTRACT

An internal recycling type fluidized bed boiler in which a fluidized bed portion of the boiler is divided by a partition into a primary combustion chamber and a thermal energy recovery chamber, at least two kinds of air supply chambers are provided below the primary combustion chamber, one for imparting a high fluidizing speed to a fluidizing medium and the other for imparting a low fluidizing speed thereto, thereby providing a whirling and circulating flow to the fluidizing medium in the primary combustion chamber. The fluidizing medium is moved downward in a moving bed in the thermal energy recovery chamber. Thermal energy recovery from exhaust gas is effected in a free board portion or downstream thereof, the cooled exhaust gas being guided to a cyclone, and fine particulate char collected at the cyclone is returned directly above or into a descending moving bed of the fluidizing medium in the primary combustion chamber and/or the thermal recovery chamber, whereby the char will not be immediately scattered to the free board portion and the char is sufficiently precipitated and it is possible to reduce NOx generated by combustion of coal or the like, in the bed.

11 Claims, 12 Drawing Sheets

Fig. 6

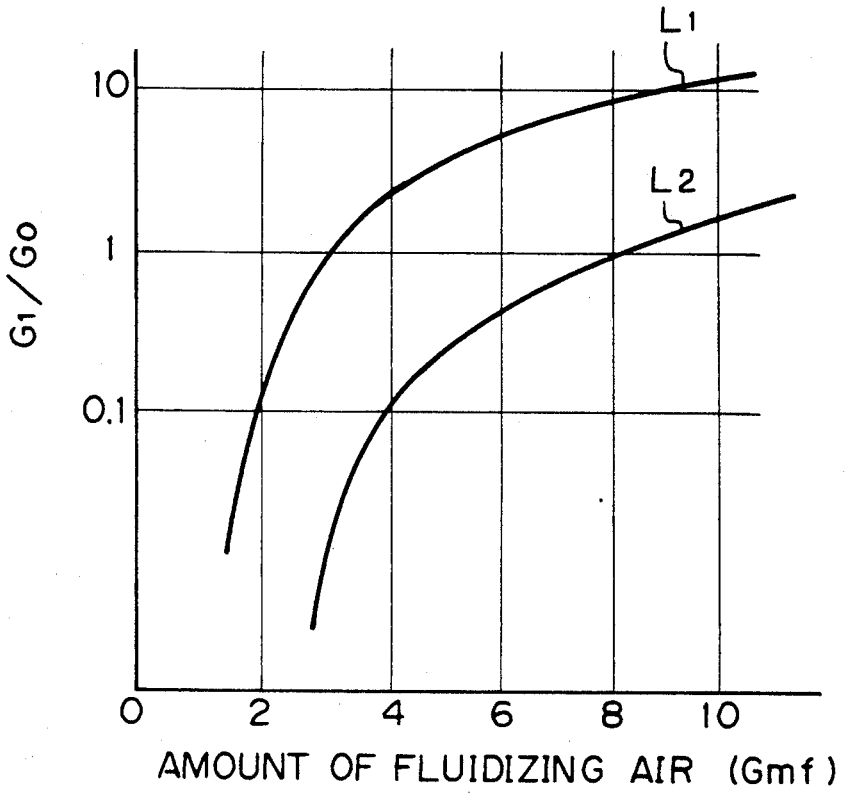

Gmf MINIMUM MASS FLOW FOR FLUIDIZATION

G1 RECYCLING AMOUNT OF FLUIDIZING MEDIUM

L1 CASE WHERE TOP OF FLUIDIZED BED REACHES UPPER END OF PARTITION WITHOUT INJECTING FLUIDIZING AIR INTO BED

L2 CASE WHERE TOP OF FLUIDIZED BED IN COMBUSTING PORTION IS APPROXIMATELY AT UPPER END OF PARTITION WALL WITH INJECTING FLUIDIZING AIR INTO BED

Go RECYCLING AMOUNT OF FLUIDIZING MEDIUM IN CASE OF L1 WITH FLUIDIZING AIR MASS FLOW 3 Gmf AT LOWER END OF INCLINED PARTITION WALL IN COMBUSTION CHAMBER

COMPOSITE RECYCLING TYPE FLUIDIZED BED BOILER

TECHNICAL FIELD

The present invention relates to an internal recycling type fluidized bed boiler in which combustion materials such as various coals, low grade coal, dressing sludge, oil cokes and the like are burnt by a so-called whirling-flow fluidized bed, the interior of a free board and a heat transfer portion provided downstream of the free board portion.

BACKGROUND OF THE INVENTION

Recently, utilization of coal as an energy source in place of petroleum has become more prevalent. In order to widely utilize coal which is inferior in its physical and chemical properties as a fuel to those of petroleum, development of processing and distribution of coal and of technology for promoting the utilization of coal has been in urgent demand. Research and development of a pulverized coal incinerating boiler and the fluidized bed boiler in the field of combustion technology have been positively advanced. With respect to combustion technology such as the above, utilization is restricted to certain kinds of coals in view of combustion efficiency, requirements of low NOx and low SOx. Also, problems such as the complexity of coal feeding systems and difficulty in controlling load fluctuations have become evident, which problems have been particularly evidenced in small and medium size boilers.

Fluidized bed boilers can be classified into two types as noted below according to the difference in a system wherein arrangement of heat transfer portions and combustion of unburnt particles flowing out from the fluidized bed are taken into account.

(1) Non-recycling type fluidized bed boilers (which are referred to as conventional type fluidized bed boilers or bubbling type fluidized bed boilers)

(2) Recycling type fluidized bed boilers

In a non-recycling type, a heat transfer tube is arranged within a fluidized bed, and heat exchange is carried out by physical contact between the burning fuel and a fluidizing medium with high heat transfer efficiency. On the other hand, in a recycling type, fine unburnt materials, ash and/or a part of the fluidizing medium (recycling solid) are merged into a flow of combustion gas and guided to a heat exchanging portion arranged independently of the combustion chamber where combustion of the unburnt particles is continued and the circulating solid having undergone heat exchange is returned to the combustion chamber, the aforesaid title being given since the solid is recycled.

A non-recycling and a recycling type fluidized bed boiler will be described with reference to FIGS. 4 and 5.

FIG. 4 shows a non-recycling type fluidized bed boiler, in which air for fluidization fed under pressure from a blower (not shown) is injected from an air chamber 74 into a boiler 71 through a diffusion plate 72 to form a fluidized bed 73, and fuel, for example, granular coal, is supplied to the fluidized bed 73 for combustion. Heat transfer tubes 76 and 77 are provided in the fluidized bed 73 and an exhaust gas outlet of a free board portion, respectively, to recover thermal energy.

Exhaust gas cooled to a relatively low temperature is guided from an exhaust gas outlet of the free board portion to a convection heat transfer portion 78 to recover thermal energy and is discharged outside the system after contained particles are recovered at a cyclone 79. Ash recovered in the convection heat transfer portion is taken out through a tube 81 and discharged outside the system via a tube 82 together with ash taken out from a tube 80, a part thereof being returned to the fluidized bed 73 for reburning through the air chamber 74 or a fuel inlet 75.

FIG. 5 shows a recycling type fluidized bed boiler, in which air for fluidization fed under pressure from a blower (not shown) is blown from an air chamber 104 into a furnace 101 through a diffusion plate 102 to fluidize and burn granular coal containing lime as a desulfurizing agent to be supplied into the furnace as needed.

Unlike a non-recycling type fluidized bed boiler, injecting speed of fluidizing air blown through the diffusion plate 102 is higher than the terminal speed of the fluidizing particles, and therefore mixing of particles and gas is more actively effected and the particles are blown upward together with gas so that a fluidizing layer and a jet-stream layer are formed in that order from the bottom over the whole zone of the combustion furnace. The particles and gas are guided to a cyclone 108 after a small amount of heat exchange is effected at a water cooling furnace wall 107 provided along the flow path. The combustion gas passed through the cyclone 108 undergoes heat exchange at a convection heat transfer portion 109 arranged in a flue at the rear portion.

On the other hand, the particles collected at the cyclone 108 are again returned to the combustion chamber via a flow passage 113, and a part of the particles is guided to an external heat exchanger 115 via a passage 114 for the purpose of controlling the furnace temperature, and after being cooled it is again returned to the combustion chamber, although part thereof may be discharged outside the system as ash. A feature lies in that the particles are recycled into the combustion chamber in a manner as just described. The recycling particles are mainly limestone supplied as a desulfurizing agent, burnt ash of supplied coal and unburnt ash, etc.

In these fluidized bed boilers, a wide variety of materials can be burnt in view of characteristics of the combustion system thereof, but some disadvantages thereof have been noted.

The disadvantages of the bubbling type fluidized bed boiler are problems such as those regarding load characteristics, complexity of the fuel supply system and abrasion of heat transfer tubes in the bed, etc.

In order to solve the problems inherent in such matters as those described above, a recycling type apparatus has become desirable. However, some further factors need to be developed in order to maintain the temperature of a recycling system including a cyclone of a combustion furnace at a proper value. In addition, there still remains a problem in the handling of the recycling solid. With respect to small and medium type boilers, it is difficult to make them compact.

DISCLOSURE OF THE INVENTION

After various studies attempting to solve the above-described problems, the present inventors have found that it is possible to make a boiler compact, promote combustion efficiency and reduce NOx by the following arrangement. That is, in an internal recycling type fluidized bed boiler in which a whirling flow is produced within a fluidized bed due to different speeds of fluidizing air, the whirling flow is utilized to form a recycling flow of a fluidizing medium relative to a thermal energy recovering chamber, a thermal energy recovery portion such as a vaporizing tube is provided in a free board portion above the fluidized bed or in a portion downstream of the free board portion and exhaust gas is, after being cooled to a low temperature by heat exchange, directed to a cyclone, and particles collected at the cyclone are returned to a descending moving bed of the fluidizing medium in the fluidized bed. The inventors further found that selection of coal is not limited to a certain kind because even coal with a high fuel ratio may be completely burned by the whirling flow, and silica sand can be used as a fluidizing medium together with limestone for reducing SOx whereby all the problems encountered in the conventional coal boilers can be solved.

The characteristics of the present invention are summarized below:

According to the first aspect of the present invention, an internal recycling type fluidized bed boiler is provided in which a fluidized bed is generally partitioned into a primary combustion chamber and a thermal energy recovery chamber, the primary combustion chamber having at least two kinds of air chambers disposed below the primary chamber, i.e. an air chamber for imparting a high fluidizing speed and an air chamber for imparting a low fluidizing speed, these different fluidizing speeds being combined to thereby impart a whirling flow to a fluidizing medium within the primary combustion chamber to form a thermal energy recovery recycling flow of fluidizing medium between the primary combustion chamber and the thermal energy recovery chamber. That is, in the internal recycling fluidized bed provided with an air chamber imparting a low fluidizing speed at a portion below and opposite the thermal energy recovery chamber relative to the primary combustion chamber, exhaust gas is guided into a cyclone and particles collected in the cyclone are returned to a descending moving bed of the primary combustion chamber or the thermal energy recovery chamber.

The collected particles are not limited to those from the cyclone but collected particles from a bag filter or the like can also be returned to the descending moving bed. Returning collected particles into the descending moving bed causes unburnt portions (char) of the collected particles to be evenly scattered within the fluidized bed so that the whole portion in the bed becomes a reducing atmosphere, thereby reducing NOx in a zone ranging from the fluidized bed to the free board portion.

The effect of and advantages in returning the char to the descending moving bed will be discussed hereunder. If the char is returned directly to the fluidized bed in the primary combustion chamber, the char is immediately scattered into the free board due to the fact that the char consists of fine particles so that there is little dwelling time for the char within the bed, thereby failing to satisfactorily effect combustion of the char itself and function as a catalyst for low NOx. However, if the char is returned to the descending moving bed, it moves downward and diffuses into the bed while it is finely granulated, and therefore the char is all moved to reach an area where NOx is generated due to combustion of coal or the like within the bed, whereby NOx is advantageously reduced.

The following two formulas must be considered in connection with the reduction of NOx:

$$C + 2NO \rightarrow CO_2 + N_2 \text{ (oxidization reaction of char)}$$

$$2CO + 2NO \rightarrow 2CO_2 + N_2 \text{ (catalyst reaction of char)}$$

The char participates in both the above reactions. It is considered that the oxidization reactivity and catalyst effect of char exert an influence on the function of reducing the generation of NOx.

According to the second aspect of the present invention, heat transfer tubes are arranged in a free board portion above a fluidized bed or downstream of the free board portion, and recovery of thermal energy is primarily effected by convection heat transfer.

In the past, a convection heat transfer portion has been provided independently of a free board portion. However, in order to make a boiler compact, such a convection heat transfer portion is provided unitarily with a free board portion at an upper part within a free board or downstream of a free board portion while sufficient volume required for secondary combustion in the free board portion is retained. With such an arrangement as outlined above, treatment of dust and recycling of char around a boiler can be facilitated as compared with the prior art. In addition, the temperature of gas entering into the cyclone becomes 250°–400° C., and therefore the cyclone need not be provided with a cast material lining, and the cyclone can be made of steel and thus light in weight, and miniaturized.

According to the third aspect, a convection heat transfer portion is provided at an upper part within a free board or a furnace wall and comprises water cooling tubes. In view of such a provision as above, heat insulating material such as refractory material is provided as a liner in the convection heat transfer portion and a water cooling furnace wall on the side of the combustion chamber in order to prevent the temperature of the combustion gas within the free board from being lowered due to radiation effect. With the above arrangement, the temperature of combustion gas is maintained so as to be effective in reducing CO or the like.

In the case where a convection heat transfer portion is provided downstream of the free board portion, refractory heat insulating material may be applied only to a water cooling wall constituting the free board portion.

As explained hereinabove, the present invention provides a composite recycling type fluidized bed boiler effecting a combination of three circulative movements, i.e. a whirling flow circulation in the primary combustion chamber, a thermal energy recovering circulative movement of a fluidizing medium recycled between a primary combustion chamber and a thermal energy recovery chamber, and an external recycling (char recycling) for returning unburnt char to a descending moving part of the bed of a fluidizing medium within a primary combustion chamber or a thermal energy recovery chamber.

BRIEF DESCRIPTION OF THE DRAWINGS

FIG. 6 is a graph indicating the relationship between the amount of fluidizing air at a lower portion of an inclined partition wall and the amount of a fluidizing medium recycled to a thermal energy recovery chamber;

DETAILED DESCRIPTION OF THE INVENTION

Figure 1:
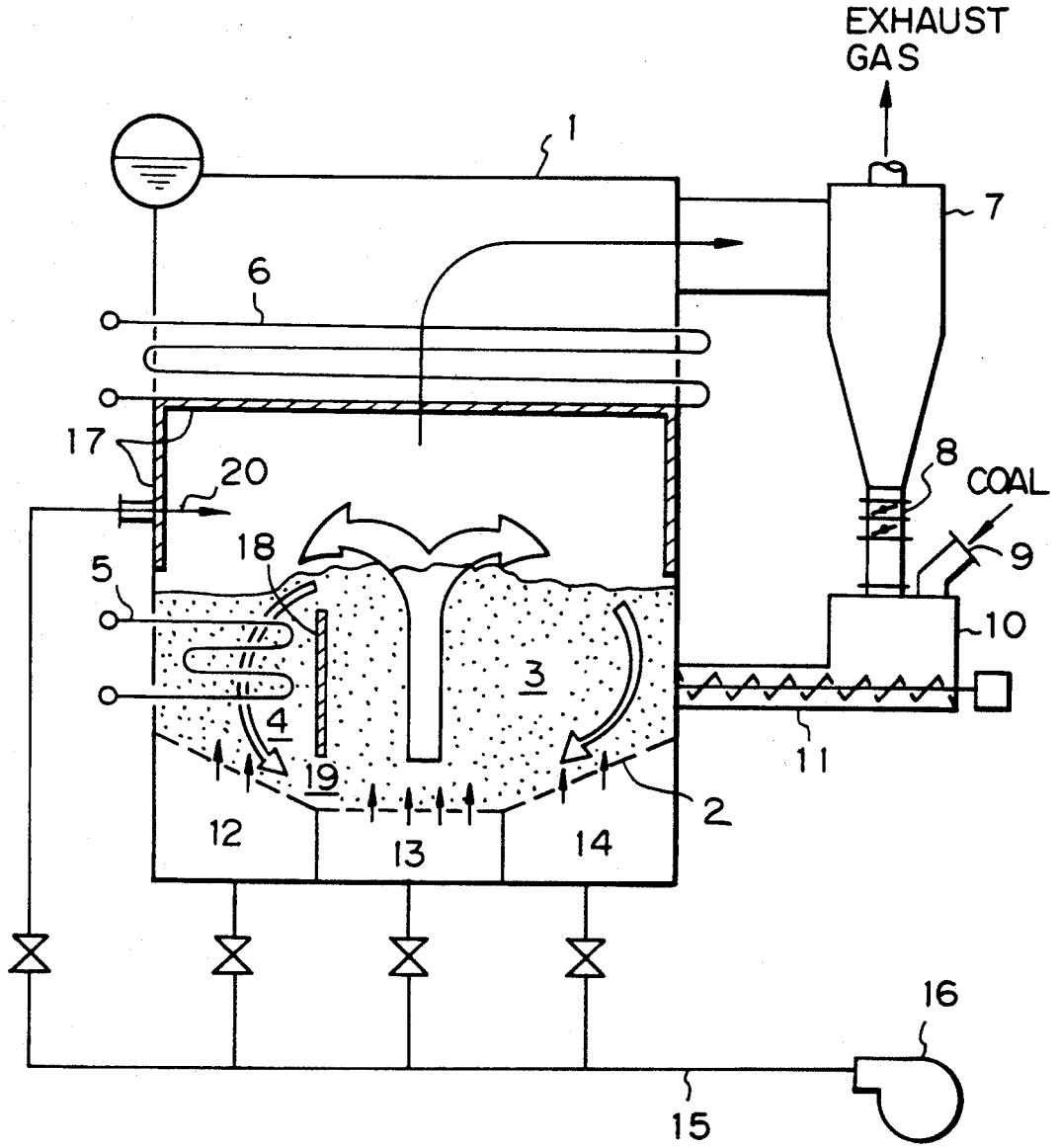
FIGS. 1, 2 and 3 are schematic views of different types of composite recycling type fluidized bed boilers, respectively, according to the present invention, in which heat transfer tubes such as vaporization tubes are disposed in an upper part within a free board.

The present invention will be schematically explained referring to the drawings.

In FIG. 1, a boiler body 1 is internally provided on the bottom thereof with a diffusion plate 2 for a fluidizing air which is introduced from a fluidizing air introducing tube 15 by means of a blower 16, the diffusion plate 2 having opposite edges arranged to be higher than a central portion of the plate, the bottom of the boiler body being formed as a concave surface.

The fluidizing air fed by the blower 16 is injected upwardly through the air diffusion plate 2 from air chambers 12, 13 and 14. The mass flow of the fluidizing air injected from the center air chamber 13 is arranged to be sufficient to form a fluidized bed of a fluidizing medium within the boiler body, that is, in the range of 4–20 Gmf, preferably in the range of 6–12 Gmf. The mass flow of the fluidizing air injected from the air chambers 12 and 14 on the opposite sides of chamber 13 is smaller than the former, generally in the range of 0–3 Gmf. It is preferable that air is injected in a mass flow of 0–2 Gmf from the air chamber 12 located below the thermal energy recovery chamber 4 and provided with a heat transfer tube 5, and air is injected in a mass flow of 0.5–2 Gmf from the air chamber 14 which forms a lower portion of the primary combustion chamber 3.

Since the mass flow of the fluidizing air injected from the air chamber 13 within the primary combustion chamber 3 is relatively larger than that of the fluidizing air injected from the air chamber 12 and 14, the air and the fluidizing medium are rapidly moved upward in the portion above the air chamber 13 forming a jet stream within the fluidized bed, and upon passing through the surface of the fluidized bed, they are diffused and the fluidizing medium falls onto the surface of the fluidized bed at the portions above the air chambers 12 and 14.

At the same time, in the fluidized bed above the air chamber 13, fluidizing medium under gentle fluidization on the opposite sides thereof moves to occupy a space from which the fluidizing medium is moved upward. The fluidizing medium in the fluidized bed above the air chambers 12 and 14 is moved to the central portion, i.e. the portion above the air chamber 13. As a result, a violent upward stream is formed in the central portion in the fluidized bed but a gentle descending moving bed is formed in the peripheral portions.

Figure 7:
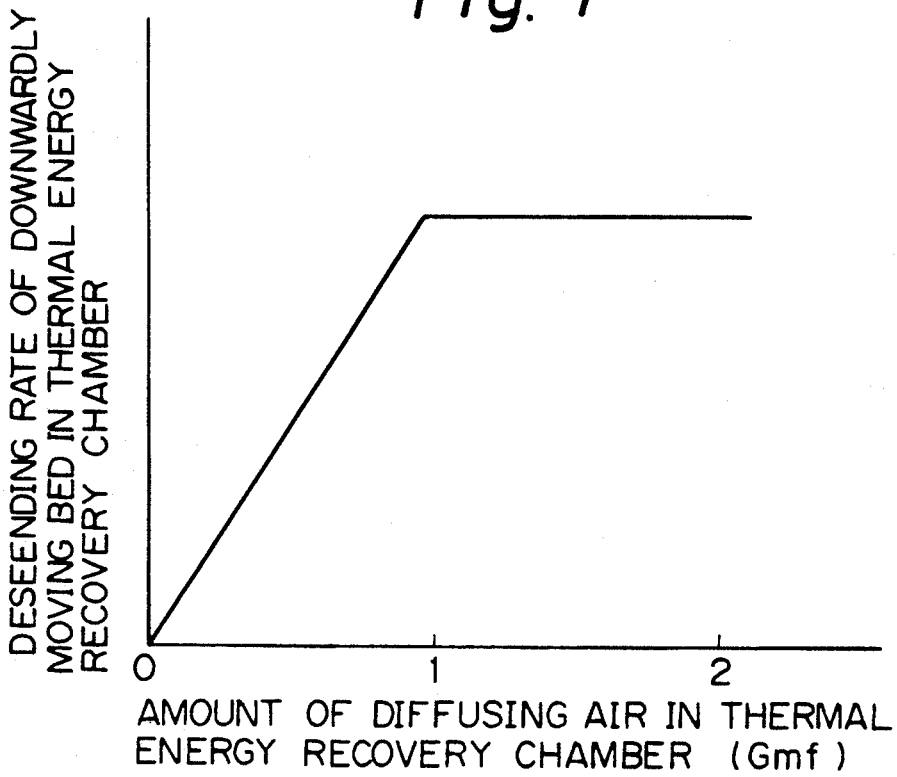
FIG. 7 is a graph indicating the relationship between an amount of diffusing air for a thermal energy recovery chamber and a rate of descent of a downwardly moving bed.
Figure 8:
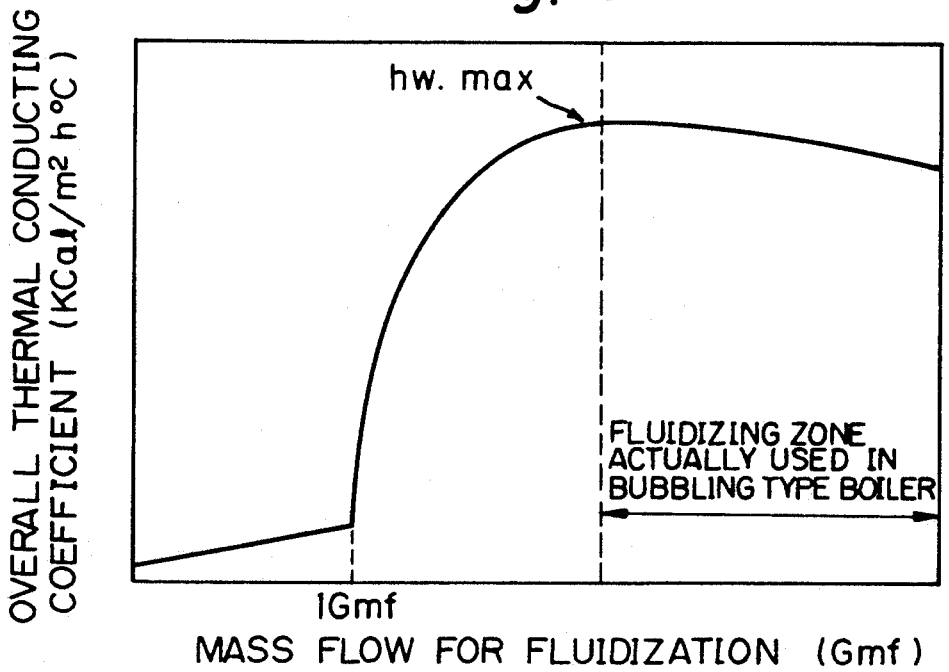
FIG. 8 is graph generally indicating a mass flow for fluidization and an overall thermal conducting coefficient.

The thermal energy recovery chamber 4 has the aforesaid descending moving bed. FIG. 8 shows the relationship between an overall thermal conducting coefficient and a fluidizing mass flow in a bubbling system. However, according to the present invention, a large overall thermal conducting coefficient is obtained at a fluidizing mass flow of 1 to 2 Gmf as shown in FIG. 7 without effecting such severe fluidization (generally 3–5 Gmf) as in the bubbling system, and sufficient thermal energy recovery can be effected.

A vertical partition wall 18 is provided internally of the fluidized bed in the portion above a boundary between the air chambers 12 and 13, and a heat transfer tube 5 is arranged at the portion above the air chamber 12 to make this portion a thermal energy recovery chamber, that is, internally of the fluidized bed between the back of the partition wall 18 and the water cooling furnace wall. The height of the partition wall 18 is designed to be sufficient for allowing the fluidizing medium to pass from a portion above the air chamber 13 over the top of wall 18 into the thermal energy recovery chamber 4 during operation, and an opening 19 is provided between the bottom of the partition wall 18 and the air diffusion plate so that the fluidizing medium within the thermal energy recovery chamber 4 may be returned to the primary combustion chamber 3. Accordingly, the fluidizing medium diffused above the surface of the fluidized bed after having been violently moved up as a jet stream within the primary combustion chamber moves beyond the partition wall 18 into the thermal energy recovery chamber, and is gradually moved down while being gently fluidized by air blown from the air chamber 12 with heat exchange being effected through the heat transfer tube 5 during its descent.

The amount of the descending fluidizing medium in the thermal energy recovery chamber which is recycled is dependent on the amount of diffusing air fed from the air chamber 12 to the thermal energy recovery chamber 4 and the amount of fluidizing air fed from the air chamber 13 to the primary combustion chamber. That is, as shown in FIG. 6, the amount $G_1$ of the fluidizing medium entering the thermal energy recovery chamber 4 increases as the amount of fluidizing air blown out of the air chamber 13 increases. Also, as shown in FIG. 7, when the amount of diffusing air fed into the thermal energy recovery chamber 4 is varied in the range of 0–1 Gmf, the amount of the fluidizing medium descending in the thermal energy recovery chamber substantially varies proportionally thereto, and is substantially constant if the amount of diffusing air in the thermal energy recovery chamber exceeds 1 Gmf.

The aforesaid constant amount of the fluidizing medium is substantially equal to the fluidizing medium amount $G_1$ moved into the thermal energy recovery chamber 4, and the amount of fluidizing medium descending in the thermal energy recovery chamber corresponds to $G_1$. By regulating these two amount of air, the descending rate of the fluidizing medium in the thermal energy recovery chamber 4 is controlled.

Figure 9:
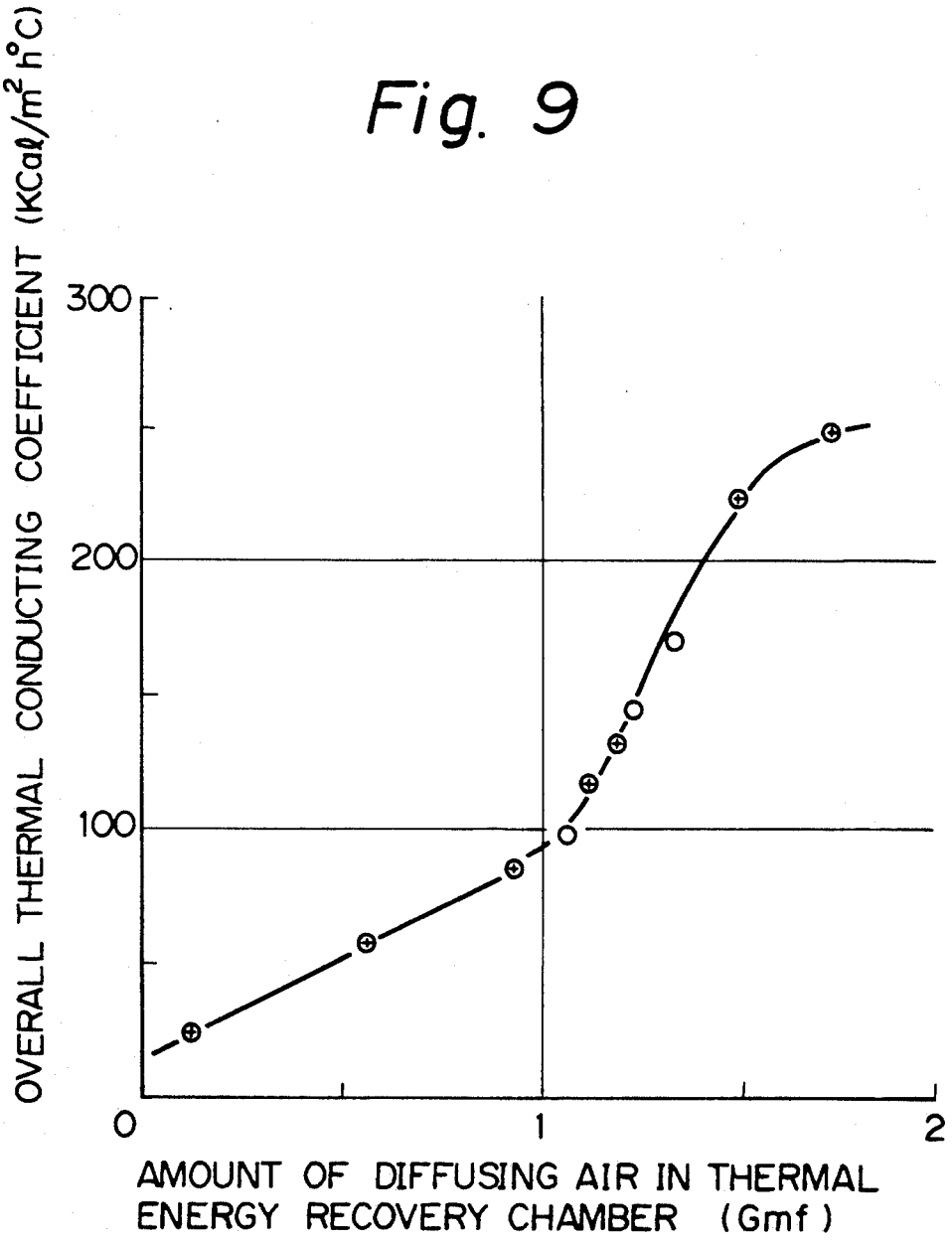
FIG. 9 is a graph indicating an amount of diffusing air for a thermal energy recovery chamber and an overall thermal conducting coefficient in an internal recycling type boiler.

Thermal energy is recovered from the descending fluidizing medium through the heat transfer tube 5. The heat conducting coefficient changes substantially linearly as shown in FIG. 9 when the amount of diffusing air fed into the thermal energy recovery chamber 4 from the air chamber 12 is changed from 0 to 1 Gmf, and therefore the thermal energy recovery amount and the fluidized bed temperature within the primary combustion chamber 3 can be optionally controlled by regulating the amount of diffusing air.

That is, with the amount of fluidizing air from the air chamber 13 in the primary combustion chamber 3 being kept constant, the fluidizing medium recycling amount increases when the amount of diffusing air within the thermal energy recovery chamber 4 is increased and at the same time the thermal conducting coefficient is increased, whereby the thermal energy recovery is considerably increased as a result of synergistic effect. If an increment of the aforesaid amount of thermal energy recovery is balanced with an increment of the generated thermal energy in the primary combustion chamber, the temperature of the fluidized bed is maintained constant.

Figure 10:
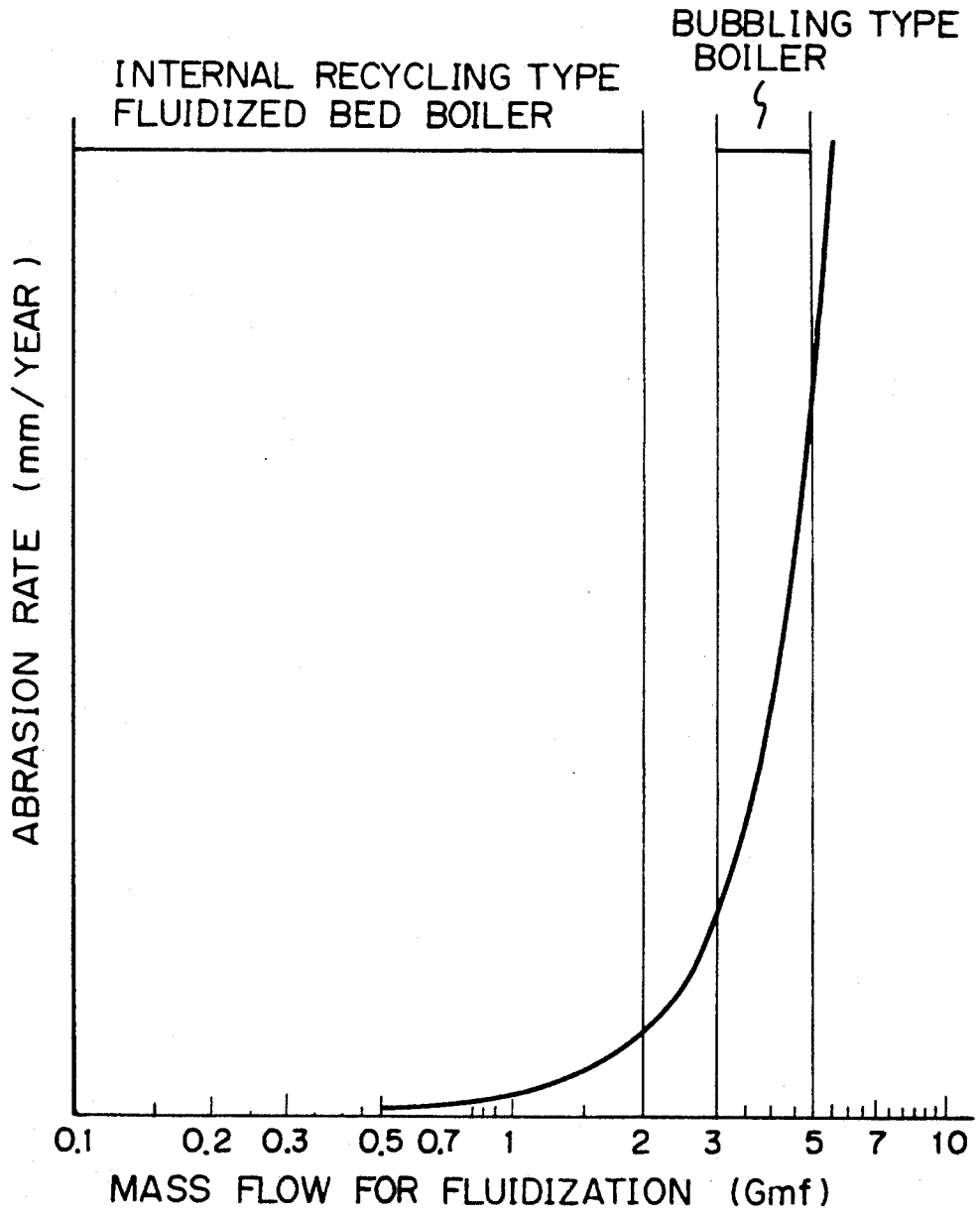
FIG. 10 is a graph indicating the relationship between a fluidizing mass flow and an abrasion rate of a heat transfer tube.

It is said that the abrasion rate of a heat transfer tube in a fluidized bed is proportional to the cube of the fluidizing medium flow rate. FIG. 10 shows the relationship between the fluidizing mass flow and the abrasion rate. That is, with the amount of diffusing air blown into the thermal energy recovery chamber being kept at 0–3 Gmf, preferably 0–2 Gmf, the heat transfer tube undergoes an extremely small degree of abrasion and thus durability can be enhanced.

On the other hand, coal as fuel is supplied to the upstream end portion of the descending moving bed within the primary combustion chamber 3. Therefore, coal supplied as above is whirled and circulated within the high temperature fluidized bed, and even coal with a high fuel ratio can be completely burnt. Since high load combustion is made available, the boiler can be miniaturized, and in addition, there is no restriction on the kind of coal which may be selected so that the use of boilers is enhanced.

Exhaust gas is discharged from the boiler and guided to the cyclone 7. On the other hand, particles collected at the cyclone pass through a double damper 8 disposed at a lower portion in the cyclone shown in FIG. 1 and are introduced into a hopper 10 together with coal simultaneously supplied, with both being mixed by a screw feeder 11 and fed to the descending moving bed of the primary combustion chamber, thereby contributing to the incineration of unburnt substance (char) in the collected particles and to the reduction of NOx. It is noted that particles collected at the cyclone will, of course, be mixed with coal due to whirling and circulation in the primary combustion chamber even if they are not preliminarily mixed in advance but instead the particles and coal are independently transported to a portion above the primary combustion chamber and fed into the descending moving bed thereof.

In an upper portion of the free board, a convection heat transfer surface means 6 is provided to effect heat recovery and function as an economizer and a vaporizing tube. A heat insulating material 17 such as a refractory material is mounted as required on the lower portion of the convection heat transfer surface means 6 and the water cooling furnace wall on the side of the combustion chamber in order to maintain the combustion temperature in the free board at a constant temperature, preferably 900° C. In the case of the convection heat transfer surface means, each heat transfer tube near the free board portion is wound with a heat insulating material. Needless to say, the pitch of the heat transfer tubes is made such as not to impede the flow of the exhaust gas.

Due to the provision of the heat insulating material 17 as described above, it is possible to maintain the temperature of the lower portion of the free board portion at a high temperature which is effective to reduce CO by air blown from an air blow opening 20 to cause a secondary combustion in the free board portion.

Figure 2:
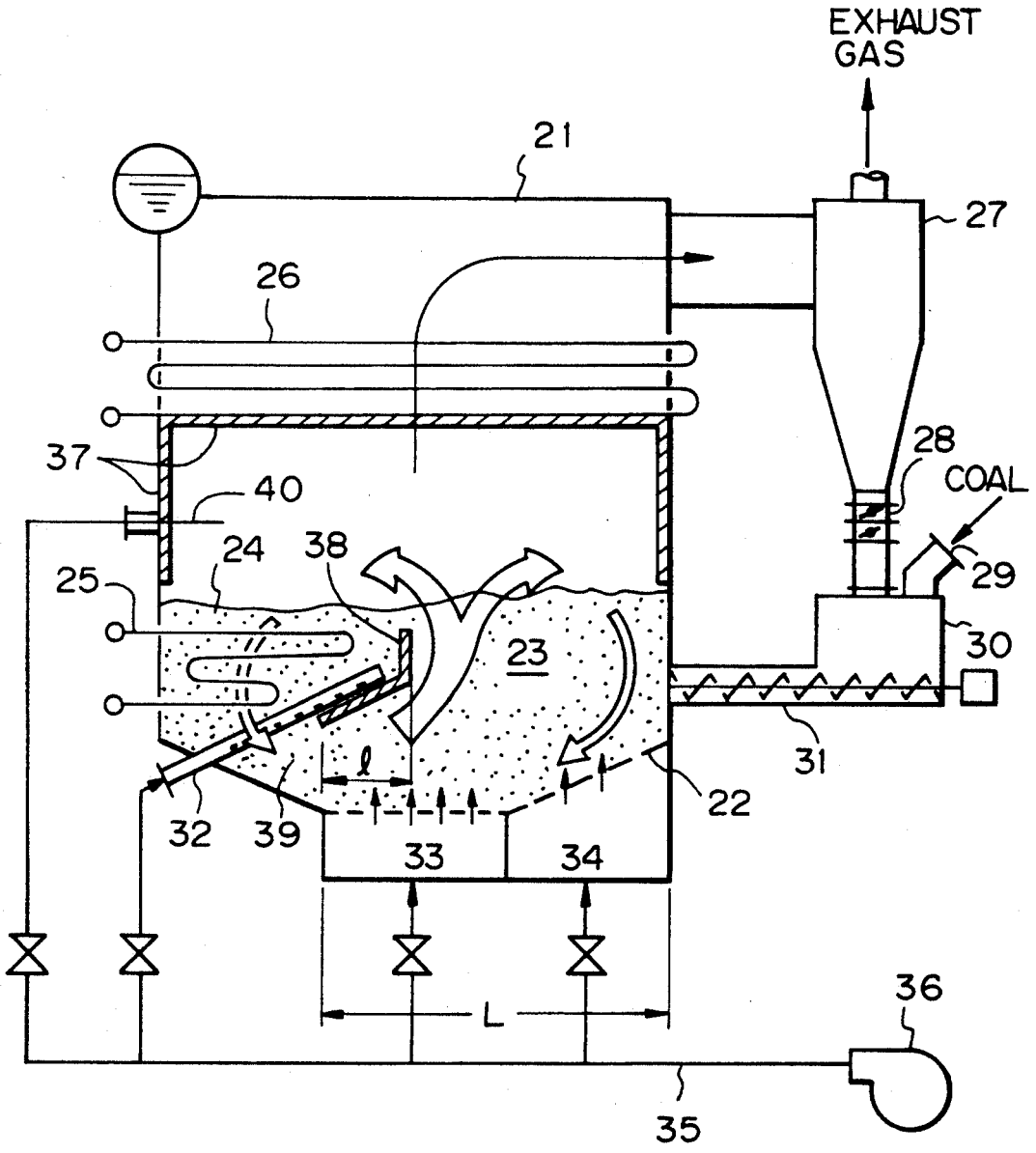

FIG. 2 shows a further embodiment of the present invention.

Basically, this embodiment is similar, with respect to it construction, to the boiler shown in FIG. 1 and performs a similar operation. What is different in this embodiment is that a lower portion of a partition wall 38 between a primary combustion chamber 23 and a thermal energy recovery chamber 24 is inclined so as to interrupt, in the primary combustion chamber, an upward flow from an air chamber 33 at a high fluidizing rate and to turn the flow toward an air chamber 34 operating at a low fluidizing rate, the angle of inclination being 10–60 degrees relative to the horizontal, preferably 25–40 degrees. The horizontal length l of the inclined portion of the partition wall projected onto the furnace bottom is 1/6 to ½, preferably ¼ to ½ of the horizontal length L of the opposing furnace bottom.

The fluidized bed at the bottom of the boiler body 21 is divided by the partition wall 38 into the thermal energy recovery chamber 24 and the primary combustion chamber 23, and an air diffusion plate 22 for fluidization is provided at the bottom of the primary combustion chamber 23.

The central portion of the diffusion plate 22 is arranged to be low and the side opposite the thermal energy recovery chamber is arranged to be high. Two air chambers 33 and 34 are provided below the diffusion plate 22.

The mass flow of fluidizing air injected from the central air chamber 33 is arranged to be sufficient for causing a fluidizing medium within the primary combustion chamber to form a fluidized bed, that is, in the range of 4–20 Gmf, preferably in the range of 6–12 Gmf, whereas the mass flow of fluidizing air injected from the air chamber 34 is arranged to be smaller than the former, in the range of 0–3 Gmf so that the fluidizing medium above the air chamber 34 is not given violent up-and-down movement but forms a descending moving bed in a weak fluidizing state. This moving bed is spread at the lower portion thereof to reach the upper portion of the air chamber 33 and therefore encounters an injecting flow of fluidizing air having a large mass flow from the air chamber 33 and is blown upwardly. Thus, a part of the fluidizing medium at the lower portion of the descending moving bed is removed, and therefore the descending moving bed is moved down due to its own weight. On the other hand, the fluidizing medium blown upwardly by the injecting flow of the fluidizing air from the air chamber 33 impinges upon the inclined partition wall 38 and is reversed and deflected, a majority falling on the upper portion of the moving bed to supplement the fluidizing medium of the moving bed moving downwardly. As a result of the continuous operation as described above, at the portion above the air chamber 34, a slowly descending moving bed is formed and as a whole, the fluidizing medium within the primary combustion chamber 23 is caused to form a whirling flow. On the other hand, a part of the fluidizing medium blown upwardly by the fluidizing air from the air chamber 33, reversed and deflected by the inclined partition wall 38 moves over the upper end of the inclined partition wall 38 and enters into the thermal energy recovery chamber 24. The fluidizing medium moved into the thermal energy recovery chamber 24 forms a gentle descending moving bed by the air blown by an air diffuser 32.

In the case where the descending rate is slow, the fluidizing medium moved into the thermal energy recovery chamber forms an angle of repose at the upper portion of the thermal energy recovery chamber, and a surplus portion thereof falls from the upper portion of the inclined partition wall 38 to the primary combustion chamber.

Within the thermal energy recovery chamber, the fluidizing medium is subjected to heat exchange through the heat transfer tube 25 while moving down slowly, after which the medium is returned through the opening 39 into the primary combustion chamber.

The amount of descending recycled medium and the amount of thermal energy recovered within the thermal energy recovery chamber are controlled by the amount of diffusing air blown into the thermal energy recovery chamber in a way similar to that of the embodiment shown in FIG. 1. In the case of the boiler shown in FIG. 2, controlling is effected by the amount of air blown from the air diffuser 32, and the mass flow thereof is arranged to be in the range of 0–3 Gmf, preferably 0–2 Gmf.

Coal as fuel is supplied to the portion above the air chamber 34 wherein the descending moving bed is formed within the primary combustion chamber 23 whereby the coal is whirled and circulated within the fluidized bed of the primary combustion chamber and incinerated under excellent conditions of combustibility.

On the other hand, exhaust gas is directed to a cyclone 27 after being discharged from the boiler. The particles collected at the cyclone 27 pass through a double damper 28 and are introduced into a hopper 30 together with coal parallelly supplied. They are mixed and supplied by a screw feeder 31 to the descending moving bed in the primary combustion chamber 23, that is, a portion above the air chamber 34, to contribute to the combustion of unburnt substance (char) in the collected particles and reduction in NOx.

Although not particularly shown, the particles collected at the cyclone 27 may be supplied independently of coal, unlike the supply device shown in FIG. 2, and the particles and coal may be fed by an airborne means instead of the screw feeder.

In the upper portion of the free board, a convection heat transfer surface means 26 is provided to effect thermal energy recovery. A heat insulating material 37 such as a refractory material is mounted on the lower portion of the convection heat transfer surface means 26 and the side of the water cooling furnace wall opposing the combustion chamber as required in order to maintain the combustion temperature of the free board at a constant temperature, preferably 900° C., and an air inlet 40 is provided for the purpose of supplying air for secondary combustion to effectively reduce CO or the like.

Figure 3:
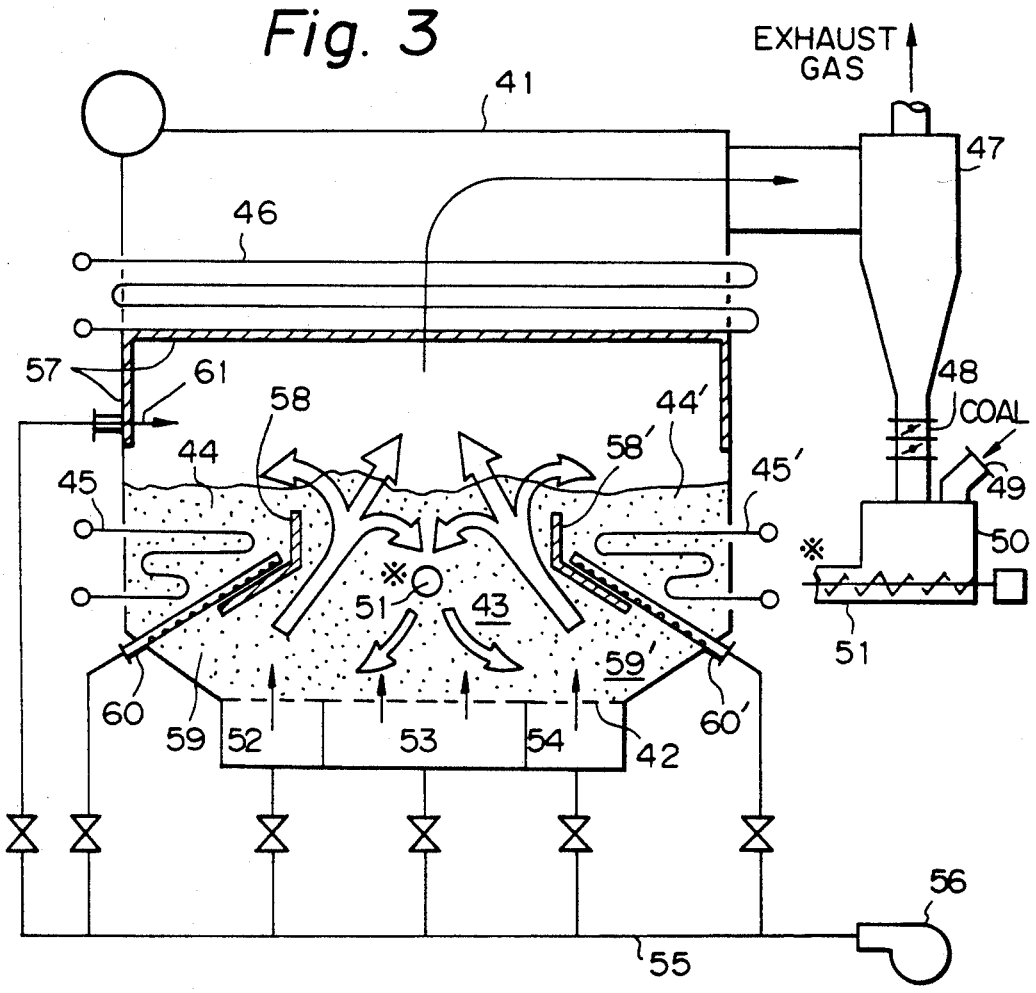
Figure 4:
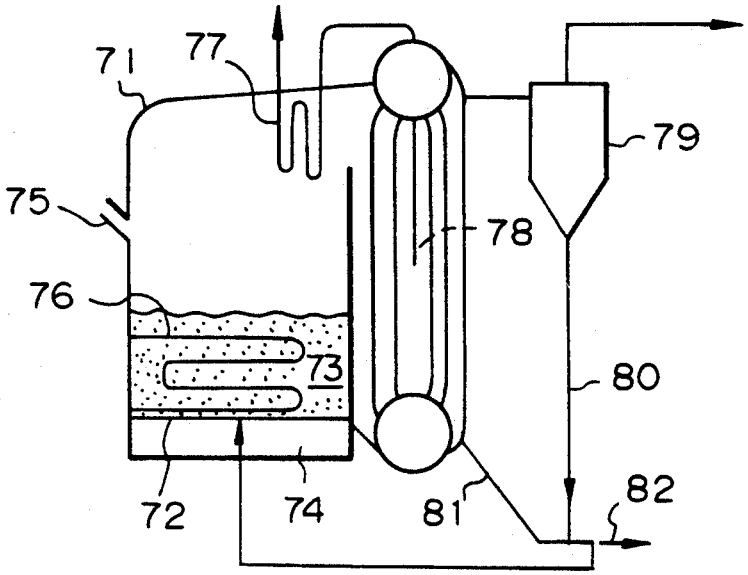
FIG. 4 is a schematic view of a conventional fluidized bed boiler.
Figure 5:
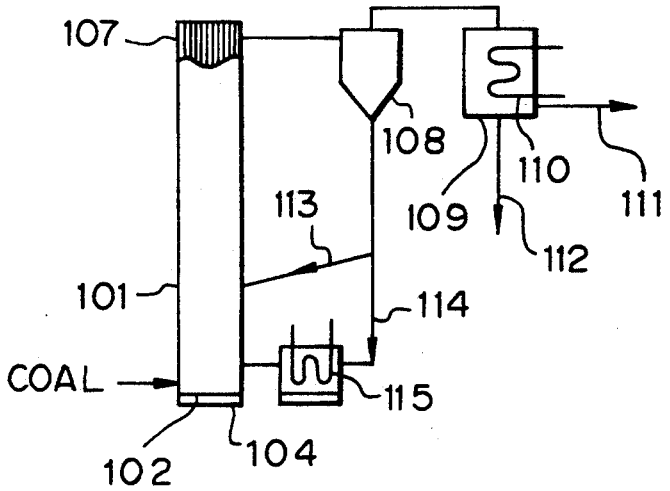
FIG. 5 is a schematic view of a conventional recycling type fluidized bed boiler.

FIG. 3 shows still another embodiment of the present invention. Basically, it is constructed as two thermal energy recovery chambers as shown in FIG. 2 in symmetrically opposed positions and joined into a unitary chamber. As a result, an air chamber 53 having a small mass flow of blown air is positioned centrally, and air chambers 52 and 54 having a large mass flow are provided on either side thereof. Therefore, the flowing stream of fluidizing medium caused by air blown out of the air chambers 52 and 54 is reversed by inclined partition walls 58 and 58' and falls on the central portion. The flow is thence formed into a descending moving bed and reaches the portion above the air chamber 53, where it is divided into left and right portions, which are again blown upwardly. Accordingly, two symmetrical whirling flows are present in the fluidized bed within the primary combustion chamber.

The coal and particles collected at the cyclone 47 are supplied to the central descending moving bed by conveyor 51.

In FIG. 3, the end of conveyor 51 is indicated by a marking * within the primary combustion chamber, and the supplying direction is perpendicular to the paper surface. While the particles collected at the cyclone and coal are mixed and supplied by a screw conveyor 51 in the embodiment shown in FIG. 3, it is to be noted that they may be supplied independently from each other, although this is not shown, or an airborne supply means may be employed.

On the other hand, when the flow of the fluidizing medium caused by air blown out of the air chambers 52 and 53 is deflected at the inclined partition walls 58 and 58', a part thereof moves over the partition walls to enter into thermal energy recovery chambers 44 and 44'.

The amount of descending fluidizing medium within the thermal energy recovery chamber is controlled by the amount of diffusing air introduced from air diffusers 60 and 60' in a manner similar to that of the diffuser shown in FIG. 2.

The fluidizing medium, after being subjected to heat exchange by heat transfer tubes 45 and 45', passes through openings 59 and 59' to return to the primary combustion chamber.

A convection heat transfer surface means 46 is provided at a portion above the free board portion to effect heat exchange. A heat insulating material 57 such as a refractory material is mounted as required on the convection heat transfer surface means 46 and the side of the water cooling furnace wall opposing the combustion chamber in order to maintain the combustion temperature in the free board at a constant temperature, preferably 900° C., and an air inlet 61 is provided for the purpose of providing air for secondary combustion to effectively reduce CO or the like.

Another embodiment will be described hereinafter with reference to FIGS. 11–14, in which thermal energy recovery from exhaust gas is carried out by a group of heat transfer tubes provided downstream of and integrally with the free board portion.

Figure 11:
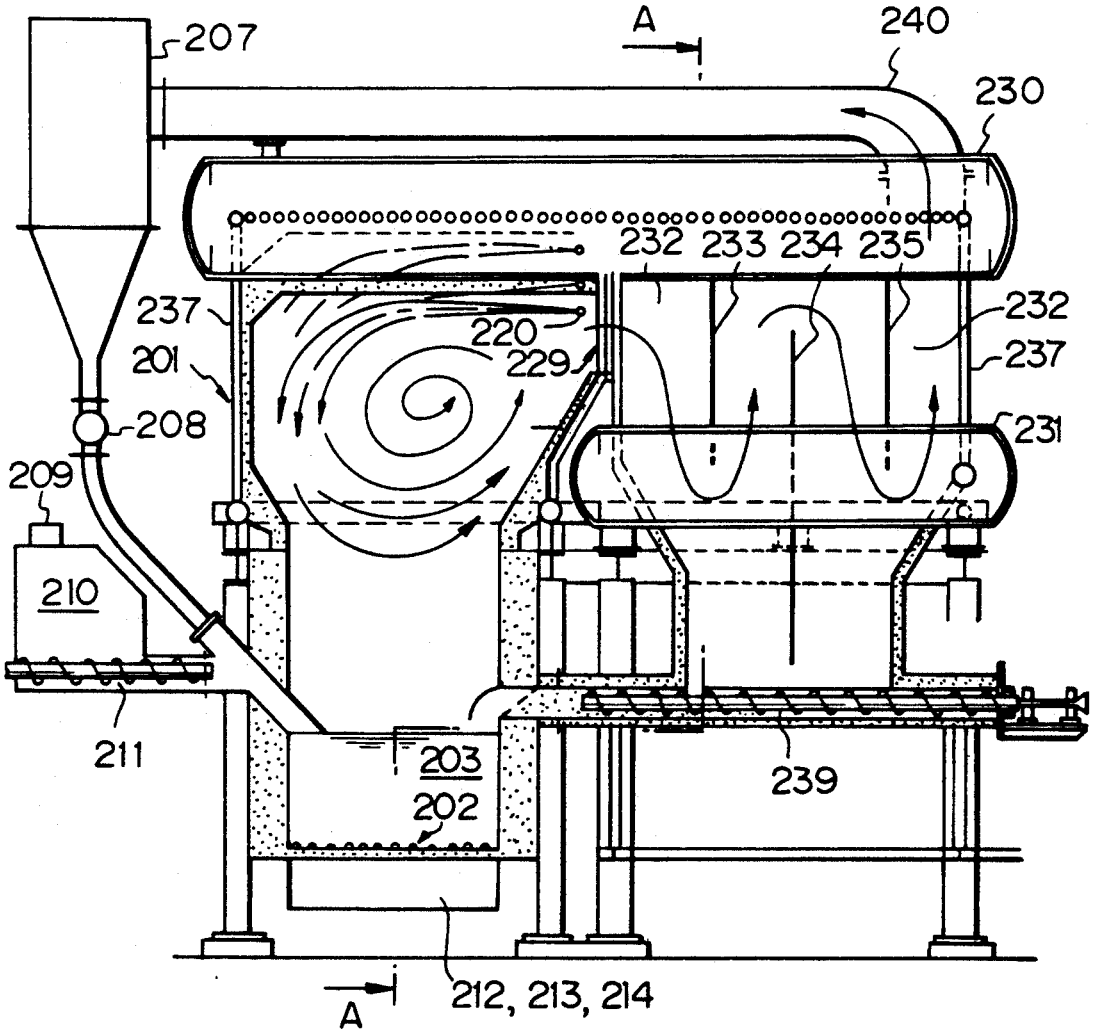
FIG. 11 is a schematic view of a composite recycling type fluidized bed boiler according to the present invention in which a group of heat transfer tubes such as vaporization tubes integrally provided in a free board portion are arranged downstream of the free board portion.
Figure 12:
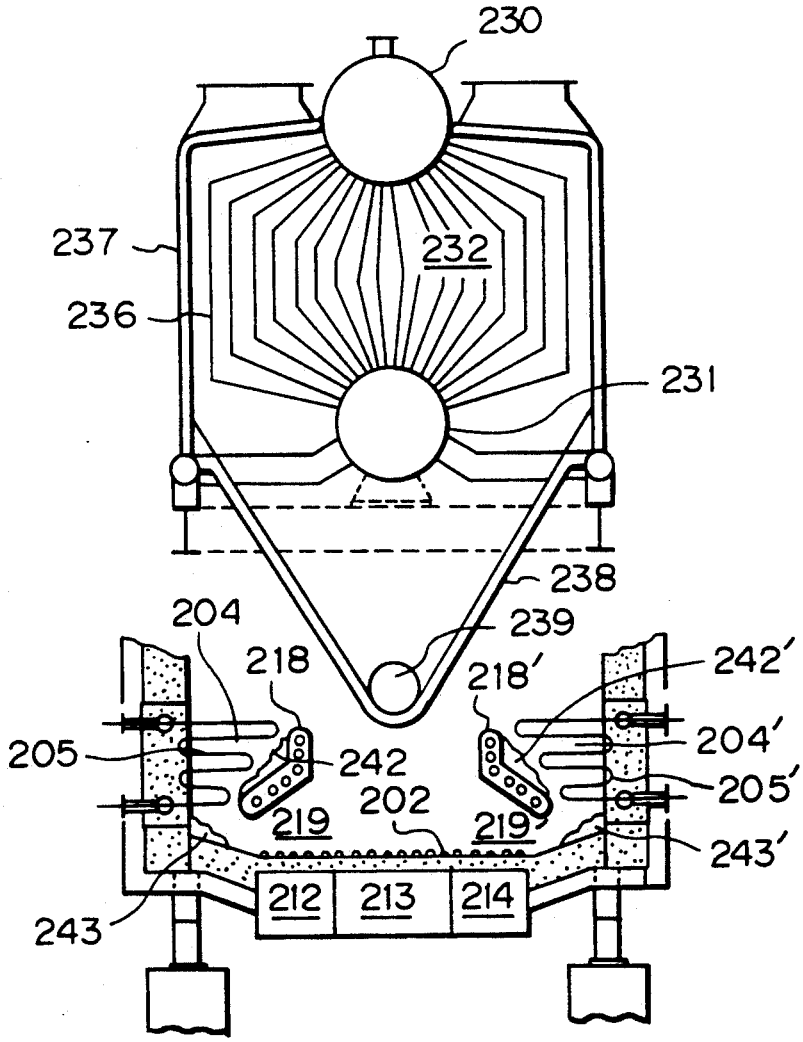
FIG. 12 is a sectional view taken along the line 12—12 of FIG. 11.

FIG. 11 is a longitudinal sectional view of a composite recycling type fluidized bed boiler showing one embodiment of the present invention in which heat recovery from exhaust gas is carried out by a group of heat transfer tubes provided downstream of and integrally with the free board portion. FIG. 12 is a sectional view taken along the line 12—12 of FIG. 11. In FIGS. 11 and 12, reference numeral 201 designates a boiler body, 202 an air diffusion nozzle for fluidization, 203 a primary combustion chamber, 204 and 204' thermal energy recovery chambers, 205 and 205' heat transfer tubes, 207 a cyclone, 208 a rotary valve, 209 a fuel supply tube, 210 a hopper, 211 a screw feeder for supplying fuel, 212, 213 and 214 air supply chambers, 218 and 218' partition walls, 219 and 219' openings at the lower portion of the thermal energy recovery chamber, 220 a secondary air introducing tube, 229 an outlet for exhaust gas, 230 a steam drum, 231 a water drum, 232 a convection heat transfer chamber, 233, 234 and 235 partition walls in the convection heat transfer chamber, 236 vaporization tubes, 237 a water pipe wall, 238 a bottom of the convection heat transfer chamber, 239 a screw conveyor, 240 an exhaust pipe for the convection heat transfer chamber, and 242, 242', 243 and 243' air diffusers of a type different from those shown in FIGS. 1 and 2.

The functions of the primary combustion chamber and the thermal energy recovery chamber, etc. shown in FIGS. 11 and 12 are exactly the same as those explained in connection with FIG. 3, but the boiler shown in FIGS. 11 and 12 is different from that shown in FIG. 3 in that a group of heat transfer tubes for recovering thermal energy from exhaust gas are not provided in the free board portion, but in a convection heat transfer portion integral with the free board portion provided downstream of the free board portion.

That is, exhaust gas discharged from the exhaust gas outlet 229 in the free board portion is introduced into the convection heat transfer chamber 232 having a group of vaporization tubes provided between the steam drum 330 and the water drum 231, undergoes heat exchange with water in the group of vaporization tubes while flowing toward the downstream end of the convection chamber in the direction as indicated by the arrow due to the presence of the partition walls arranged within the convection heat transfer chamber, is cooled to 250–400° C. and thereafter introduced into the cyclone 207 via the exhaust pipe 240 so that fine particles containing char are collected at the cyclone and the gas is then discharged into the atmosphere. The fine particles containing the char collected at the cyclone are returned via the rotary valve 208 and a charging opening to a portion directly above the descending moving bed of the primary combustion chamber 203, the charging opening also being for fuel such as coal supplied to the boiler via the charging opening 209, the hopper 210 and the screw feeder 211.

On the other hand, fluidizing medium having a relatively large grain size is separated in the convection heat transfer chamber 232 and grains containing desulfurizer and char are gathered in a V-shaped bottom at the lower portion of the convection heat transfer chamber and then returned by the screw conveyor 239 to the portion directly above the descending moving bed on the side opposite the fuel supply side of the primary combustion chamber.

In the case where the convection heat transfer chamber is provided downstream of the free board portion as shown in FIGS. 11 and 12, secondary air is blown in a reverse direction to the flowing direction of the exhaust gas flowing into the convection heat transfer chamber from the free board portion thereby causing a whirling flow in the free board portion so that oxygen and exhaust gas are efficiently stirred and mixed to effectively promote reduction of CO.

Another embodiment will be described with reference to FIG. 13.

Figure 13:
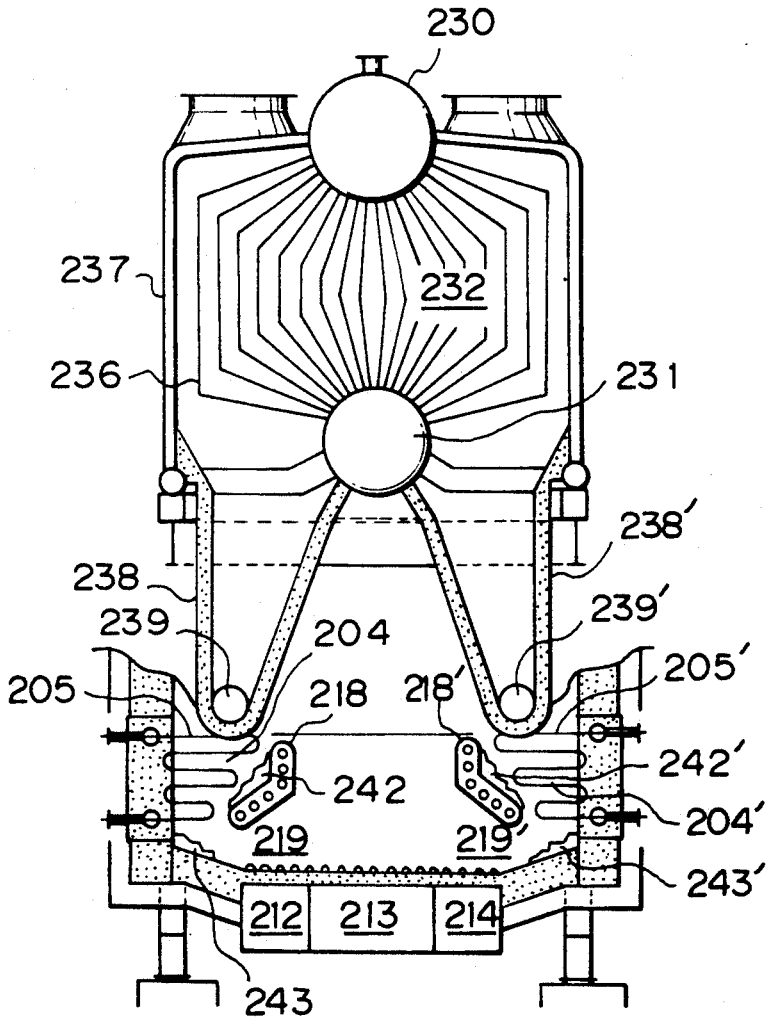
FIG. 13 is a sectional view similar to FIG. 12 of a composite recycling type fluidized bed boiler designed so that a group of heat transfer tubes such as vaporization tubes integrally provided with a free board portion are disposed downstream of the free board portion and relatively large particles collected at a group of heat transfer tubes are returned to left and right thermal energy recovery chambers disposed on opposite sides of a primary combustion chamber.

FIG. 13 is a sectional view similar to FIG. 12, and reference numerals in FIG. 13 designate the same parts as those in FIG. 12 except that 238' designates a V-shaped bottom of the convection heat transfer portion and 239' designates a screw conveyor.

This embodiment is different from the boiler shown in FIGS. 11 and 12 only in that two V-shaped bottoms 238 and 238+ (W-shaped bottom) are provided at the lower portion of the convection heat transfer chamber, and that particles containing relatively large char collected at the V-shaped bottoms 238 and 238' are returned by screw conveyors 239 and 329' to the portion directly above the descending moving beds 204 and 204' of the fluidizing medium in the thermal energy recovery chambers provided at opposite sides of the combustion chamber.

Figure 14:
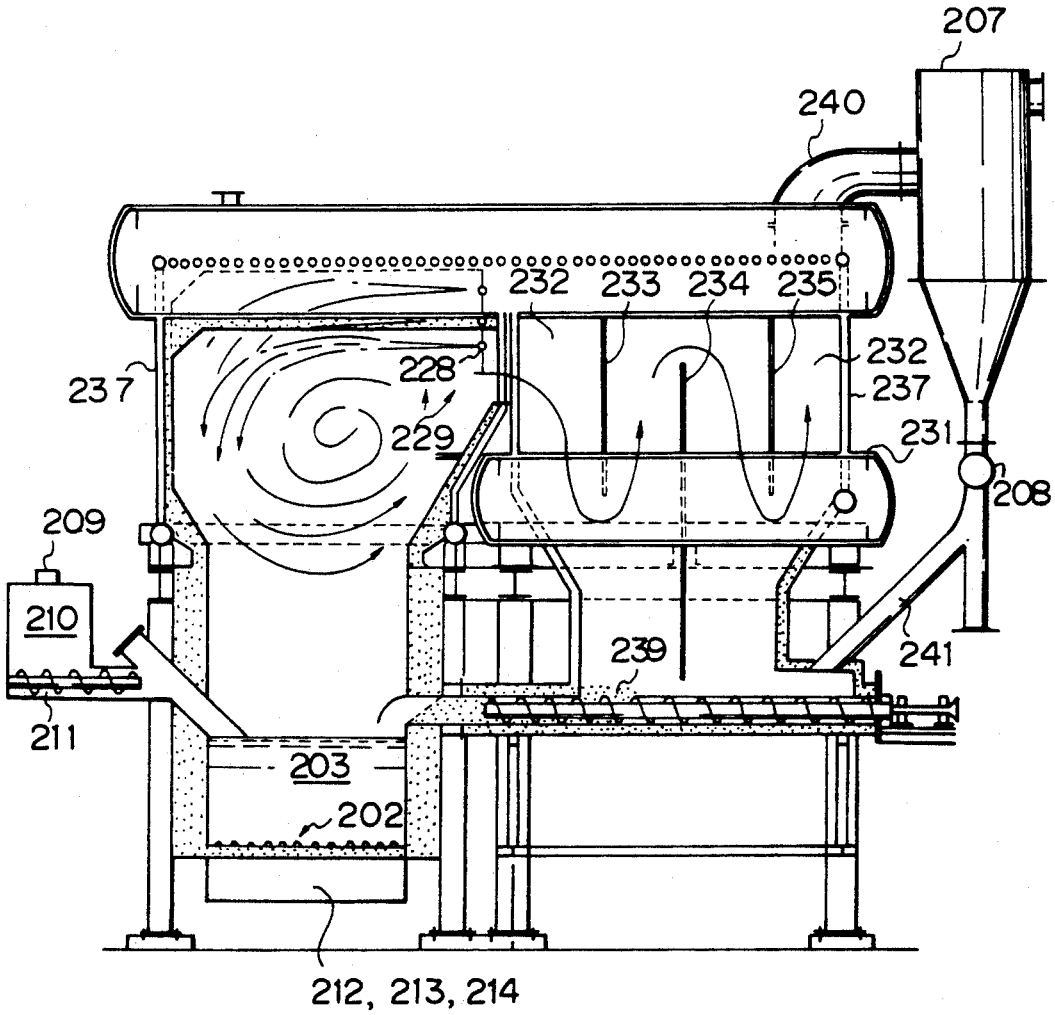
FIG. 14 is a view similar to FIG. 11 showing an embodiment in which particles containing fine char collected at a cyclone are returned to a carrier such as a conveyor for returning particles collected at a group of heat transfer tubes to the fluidized bed portion.

FIG. 14 shows still another embodiment of the present invention.

Reference numerals used in FIG. 14 designate the same parts as those used in FIG. 11 except that the reference numeral 241 designates a conduit. The embodiment shown in FIG. 14 is different from that of FIG. 11 in that fine particles containing char collected at the cyclone 207 are directed to the screw conveyor 239 at the lower portion of the convection heat transfer chamber 232 by the conduit 241 and then returned together with the particles containing relatively large char collected in the convection heat transfer chamber to the portion directly above the descending moving bed in the primary combustion chamber.

We claim:

1. A composite recycling type fluidized bed boiler comprising:

a fluidized bed portion having a partition dividing said fluidized bed portion into a primary combustion chamber and a thermal energy recovery chamber;

at least two air chambers provided below said primary combustion chamber and having means for injecting air mass flows into said fluidized bed portion, one air chamber being a high air mass flow chamber for imparting a high fluidizing speed to a fluidizing medium thereabove for producing a high speed upward flow of the fluidizing medium in said primary combustion chamber, and the other being a low air mass flow chamber for controlling the speed of flow of the fluidizing medium thereabove to a low downward speed, thereby providing a whirling and circulating flow to the fluidizing medium within the primary combustion chamber and into said thermal energy recovery chamber by a combination of the air mass flows producing the different speed flows of fluidizing medium to form a recycling flow of the fluidizing medium within said primary combustion chamber;

further air mass flow injecting means associated with said thermal energy recovery chamber for controlling the flow of fluidizing medium therethrough to a low downward speed;

exhaust gas flow path defining means defining a flow path for exhaust gas out of said fluidized bed portion;

thermal energy recovery means in said thermal energy recovery chamber and further thermal energy recovery means in said exhaust gas flow path defining means;

particle recovery means at a downstream end of said exhaust gas flow path defining means for collecting particles in exhaust gas from said fluidized bed portion; and particle conveying means for conveying particles recovered in said particle recovery means into said fluidized bed portion into at least one of said slow downward speed flows of fluidizing medium.

2. A composite recycling type fluidized bed boiler as claimed in claim 1 in which said particle conveying means is connected to said primary combustion chamber intermediate the length of the downward flow of the fluidizing medium therein.

3. A composite recycling type fluidized bed boiler as claimed in claim 1 in which said partition wall is positioned and inclined so as to interrupt an upward flow of fluidizing air injected from said one air chamber and to reverse and deflect upwardly flowing fluidizing medium laterally toward a position above said other air chamber.

4. A composite recycling type fluidized bed boiler as claimed in claim 1 or 3 in which a desulfurizer is supplied to the downward flow of fluidizing medium in said primary combustion chamber.

5. A composite recycling type fluidized bed boiler as claimed in claim 1 or 3 in which said further thermal energy recovery means comprises means for recovering sufficient heat to cool exhaust gas from said fluidized bed portion to a temperature of from 250–400° C.

6. A composite recycling type fluidized bed boiler as claimed in claim 1 or 3 in which said further thermal energy recovery means comprises a group of heat transfer tubes in a free board portion above the fluidized bed portion.

7. A composite recycling type fluidized bed boiler as claimed in claim 1 or 3 in which said further thermal energy recovery means comprises a group of heat transfer tubes in a freeboard portion above the fluidized bed portion and downstream along said exhaust gas flow path defining means.

8. A composite recycling type fluidized bed boiler as claimed in claim 1 in which said particle conveying means is connected to said primary combustion chamber at a point directly above the downward flow of the fluidizing medium therein.

9. A composite recycling type fluidized bed boiler as claimed in claim 1 in which said particle conveying means is connected to said thermal recovery chamber at a point directly above the downward flow of the fluidizing medium therein.

10. A composite recycling type fluidized bed boiler as claimed in claim 1 in which said particle conveying means is connected to said thermal energy recovery chamber intermediate the length of the downward flow of the fluidizing medium therein.

11. A composite recycling type of fluidized bed boiler as claimed in claim 1 in which said fluidized bed portion has a freeboard portion in the upper part thereof above fluidizing medium therein, and further comprising heat insulating material surrounding said freeboard portion of maintaining a high temperature of exhaust gas therewithin so as to reduce CO in the exhaust gas.

* * * * *

UNITED STATES PATENT AND TRADEMARK OFFICE

CERTIFICATE OF CORRECTION

PATENT NO. : 5,156,099

DATED : October 20, 1992

INVENTOR(S) : Takahiro OHSHITA, Shuichi NAGATO, Norihisa MIYOSHI

It is certified that error appears in the above-identified patent and that said Letters Patent is hereby corrected as shown below:

On the title page, item [30], "63-125135" should read --63-215135--.

Signed and Sealed this

Fourteenth Day of December, 1993

*Attest:*

*Attesting Officer*

BRUCE LEHMAN

*Commissioner of Patents and Trademarks*